US005527165A

United States Patent [19]

Schadeck

[11] Patent Number: 5,527,165

[45] Date of Patent: Jun. 18, 1996

[54] PRESSURIZED VAPOR DRIVEN ROTARY ENGINE

[75] Inventor: Mathew A. Schadeck, Salinas, Calif.

[73] Assignee: Magnitude Technologies, Inc., Saratoga, Calif.

[21] Appl. No.: 228,952

[22] Filed: Apr. 14, 1994

Related U.S. Application Data

[63] Continuation of Ser. No. 34,631, Mar. 22, 1993, abandoned, which is a continuation of Ser. No. 917,559, Jul. 21, 1992, abandoned, which is a continuation of Ser. No. 652,802, Feb. 8, 1991, Pat. No. 5,147,191.

[51] Int. Cl.[6] ..... F01C 1/077

[52] U.S. Cl. ..... 418/36

[58] Field of Search ..... 418/36, 38

[56] References Cited

U.S. PATENT DOCUMENTS

| | | | |
|---|---|---|---|
| 1,095,034 | 4/1914 | Sanchez et al. | 418/36 |
| 1,676,211 | 7/1928 | Bullington | 418/36 |
| 2,450,150 | 9/1948 | McCulloch et al. | 418/36 |
| 3,114,007 | 8/1964 | Kauertz | 418/36 |
| 3,356,079 | 12/1967 | Rolfsmeyer | 418/36 |
| 3,592,571 | 7/1971 | Drury | 418/36 |
| 3,801,237 | 4/1974 | Gotthold | 418/36 |
| 3,822,971 | 7/1974 | Chahrouri | 418/36 |
| 3,829,257 | 8/1974 | Goering | 418/36 |
| 3,890,939 | 6/1975 | McIntosh | 418/36 |
| 4,035,111 | 7/1977 | Cronen, Sr. | 418/38 |
| 4,084,550 | 4/1978 | Gaspar | 418/36 |

FOREIGN PATENT DOCUMENTS

| | | | |
|---|---|---|---|
| 1031180 | 3/1953 | France | 418/36 |
| 1332064 | 6/1963 | France | 418/36 |
| 2124430 | 12/1971 | Germany | 418/36 |
| 2360078 | 6/1975 | Germany | 418/36 |

OTHER PUBLICATIONS

McGraw–Hill Scientific Enclyclopedia, pp. 552–553, "Rotary Engine".

*Primary Examiner*—John J. Vrablik

*Attorney, Agent, or Firm*—Townsend and Townsend and Crew

[57] ABSTRACT

A rotary engine including a piston assembly having first and second adjacent hubs. The hubs are rotatably mounted in a housing about a common axis where they are coupled to two drive shafts that are concentrically arranged about the common axis. A first and second set of pistons extend radially outwardly from the first and second hubs, respectfully. Each piston head from the second set of piston heads is circumferentially spaced from a piston head of the first set to form a fuel expansion chamber therebetween. The distance between the rotational exes of the hubs and the outer peripheral surface of the piston heads is at least three times the distance between the outer peripheral surface of the piston assembly hubs and the outer periphery of the piston heads, i.e., the radial depth of the expansion chambers. This construction permits the moment arm between the piston heads and the drive shafts and, thus, the torque developed by the engine to be relatively large as compared to typical reciprocating combustion engines.

15 Claims, 6 Drawing Sheets

PRESSURIZED VAPOR DRIVEN ROTARY ENGINE

This is a continuation of application Ser. No. 08/034,631 filed Mar. 22, 1993, now abandoned which application is a continuation of U.S. patent application Ser. No. 07/917,559, filed Jul. 21, 1992 and now abandoned. U.S. patent application Ser. No. 07/917,559 was a continuation of U.S. patent application Ser. No. 07/652,802 which was filed on Feb. 8, 1991 and issued as U.S. Pat. No. 5,147,191.

BACKGROUND OF THE INVENTION

The present invention relates to rotary drives generally, and more particularly to a noncombustion pressurized vapor driven rotary engine.

Conventional internal combustion engines have proven to be the single most prevalent source of atmospheric pollution. To a very large degree, the pollution results from the need to maximize the power and performance of such engines which leads to high compression ratios which in turn result in incomplete combustion processes and the emission of large amounts of gaseous and particulate pollutants. In an effort to remedy the emission pollution problems, complex valving arrangements and electronic control circuits have been added to the basic design of the engines. In some respects, emissions have been substantially reduced by such efforts. However, this reduction in emissions has resulted in a substantial increase in the cost of the engines. Further, engine efficiencies have been reduced to an extent.

Further, typical reciprocating internal combustion engines are relatively inefficient systems primarily due to the translation of linear piston motion to rotary motion. Attempts have been made in the past to depart from the conventional concept of reciprocating internal combustion engines. Presently, the most widely utilized alternative which has been accepted for commercial applications in automobiles is a rotary engine commonly known as the "Wankel engine". It employs a generally triangular eccentrically rotating piston disposed within an elongate, generally oval chamber. The piston rotates within the chamber and alternatingly intakes a fuel mixture, compresses it, ignites it, and exhausts it, the same cycle as a reciprocating engine but with rotary motion. Mechanically this engine has been a substantial simplification over the conventional reciprocating piston-type internal combustion engine because it has greatly simplified valving and because linearly reciprocating pistons, interconnected by complicated crankshafts, have been eliminated. However, the serious concern regarding pollution has not been eliminated with the Wankel engine. Further, the seals in the Wankel engine remain subject to extreme wear and tear.

SUMMARY OF THE INVENTION

The present invention is directed to a rotary engine that avoids the problems and disadvantages of the prior art. The invention accomplishes this goal by providing a rotary engine with a piston assembly having first and second adjacent hubs. The hubs are rotatably mounted in a housing about a common axis. A first and second set of pistons extend radially outwardly from the first and second hubs, respectively. Each piston head from the second set of piston heads is circumferentially spaced from a piston head of the first set to form a fuel expansion chamber therebetween. The distance between the rotational axes of the hubs and the outer peripheral surface of the piston heads is at least three times the distance between the outer peripheral surface of the piston assembly hubs and the outer periphery of the piston heads, i.e., the radial depth of the expansion chambers.

The relative dimensions described maximize the efficiency of the engine. By maintaining the size of the expansion chambers in the radial direction relatively small, the mean force or pressure acting against the working surfaces of the piston heads is maintained toward the perimeter of the piston assemblies. As a result, the moment arm is maximized. This maximizes torque, while minimizing the required pressure necessary to operate the engine.

In addition, the reduction in expansion chamber size reduces the size of the piston heads, thereby making the engine more compact.

A further advantage of relatively small expansion chamber dimensions is improved fuel efficiency (i.e., the volume of pressurized vapor consumed is reduced).

Another advantage of the present invention is that the pistons run ahead of the pressure acting thereon. Accordingly, vapor leakage essentially does not occur, thereby eliminating the need for seals.

Further, the motion of the pistons merely cause them to accelerate and decelerate their rate of rotation. This eliminates one of the main undesirable engine characteristics, vibration experienced from high speed engine mass travel reversals as are encountered in conventional reciprocating internal combustion engines. In addition, the rotating parts effectively constitute a fly wheel which adds inertia to the available output of the engine without the requirement for a separate fly wheel.

The above is a brief description of some deficiencies in the prior art and advantages of the present invention. Other features, advantages and embodiments of the invention will be apparent to those skilled in the art from the following description, accompanying drawings and appended claims.

DESCRIPTION OF THE PREFERRED EMBODIMENT

Figure 1:
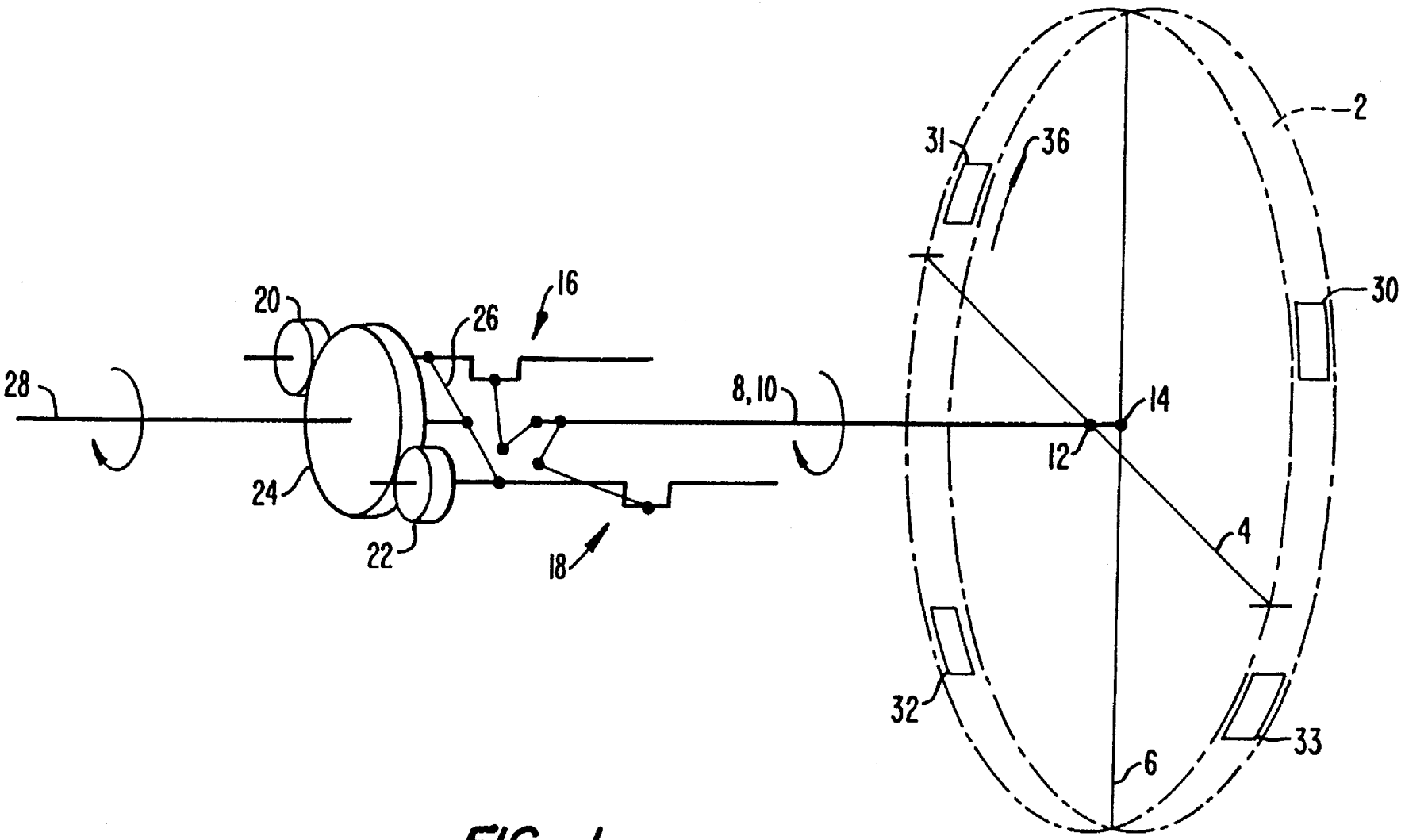
FIG. 1 diagrammatically illustrates a rotary engine in accordance with the principles of the present invention.

Referring to the drawings in detail, wherein like numerals indicate like elements, rotary engine 1 is illustrated in accordance with the principles of the present invention.

Referring to FIG. 1, the dynamics of the rotary engine are diagrammatically illustrated. Two piston assemblies, each including a pair of diametrically opposed pistons are disposed in piston assembly housing 2. These assemblies are diagrammatically shown by lines 4 and 6 which represent the center lines of each piston pair.

Piston assembly housing 2 includes inlet ports 30, 32 and outlet or exhaust ports 31, 33. Inlet ports 30 and 32 are connected to a source of pressurized gas, liquid or vapor (not shown), such as catalyzed vapors, steam, and expanded liquified atmospheric gases (liquid-air), through an on-off valve (not shown). The position of piston assemblies 4 and 6 control injection and exhaust of the vapor as will be discussed below. Accordingly, the need for inlet and exhaust valves are eliminated. Further, if liquid air is used as a fuel it should be heated to prevent freezing in the engine.

When vapor pressure is applied through inlet ports 30 and 32, the pressurized fluid enters one of the four gas expansion chambers formed between adjacent piston assemblies. The gas pressure acting upon opposing, angularly adjacent piston faces tends to urge the respective pistons away from each other through a limited arc about the axis of concentric drive shafts 8 and 10. At the end of this power stroke the pistons are urged toward each other during exhaust as will be explained in more detail in the description of FIG. 5. The above piston movement is transmitted to concentric drive shafts 8 and 10 through coupling points 12 and 14. Drive shafts 8 and 10 are coupled to crank assemblies 16 and 18 which transform the piston motion into rotational motion that is then transmitted to planet gears 20 and 22. As planet gears 20 and 22 rotate about their axes, they orbit stationary sun gear 24. Crank assemblies 16 and 18 follow the orbital path of planet gears 20 and 22 and, thus, rotate shafts 8 and 10 which, in turn, rotate piston assemblies 4 and 6. Accordingly, fluid pressure action on piston assemblies 4 and 6 is converted to a unidirectional torque as designated by arrow 36.

At the other end of the engine, crank assemblies 16 and 18 are coupled to crank assembly housing 26 which is coupled to output shaft 28. Accordingly, when planet gears 20 and 22 orbit sun gear 24, crank assemblies 16 and 18, together with crank assembly housing 26, orbit output shaft 28. Since crank assembly housing 26 is coupled to output shaft 28, output shaft 28 rotates. The rotary engine is constructed such that the position of the piston assemblies is automatically coordinated with the injection of pressurized fluid through inlet ports 30 and 32 as will be discussed below.

Figure 2:
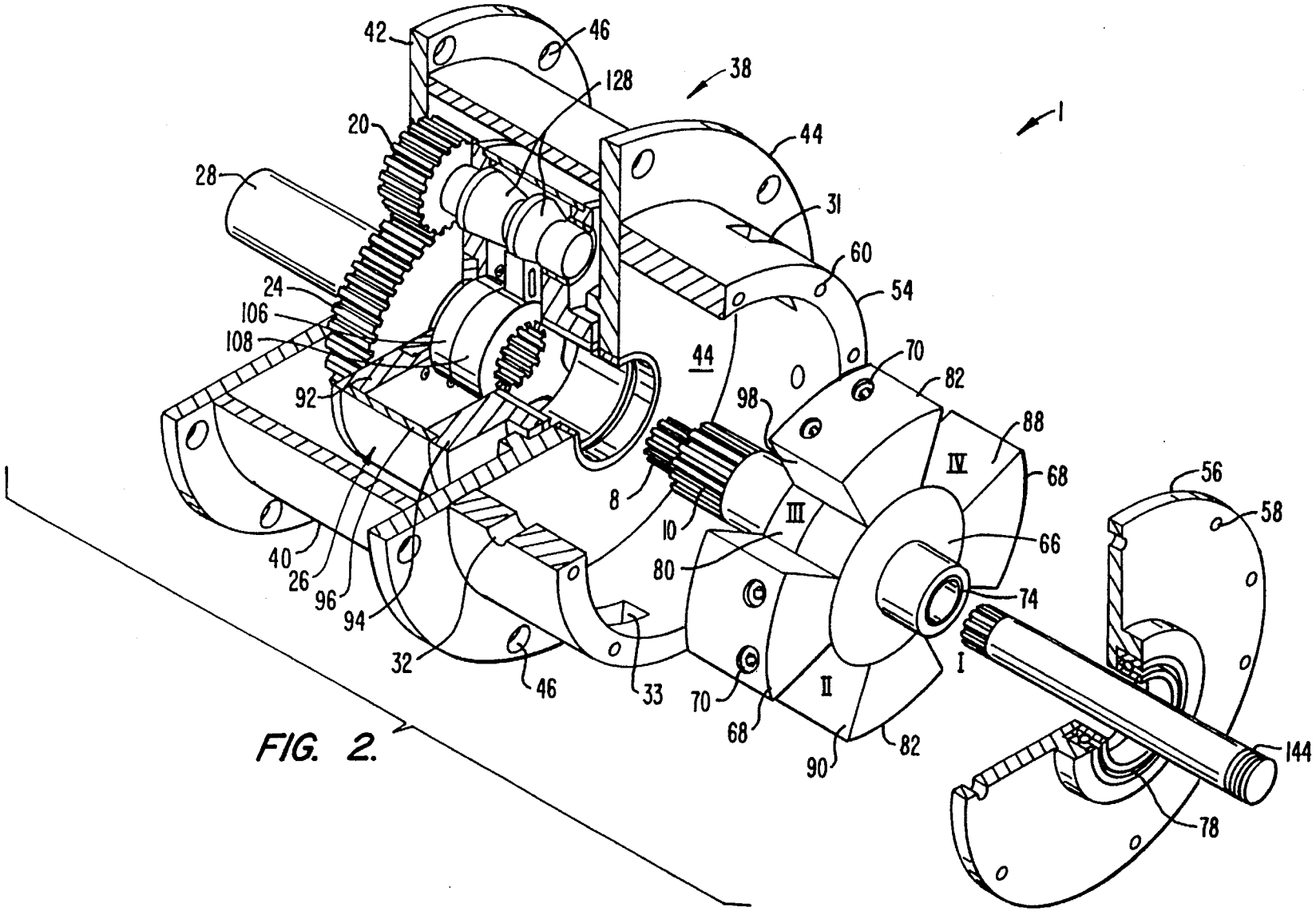
FIG. 2 is a partial cut away and exploded view of the of the rotary engine the present invention.
Figure 3:
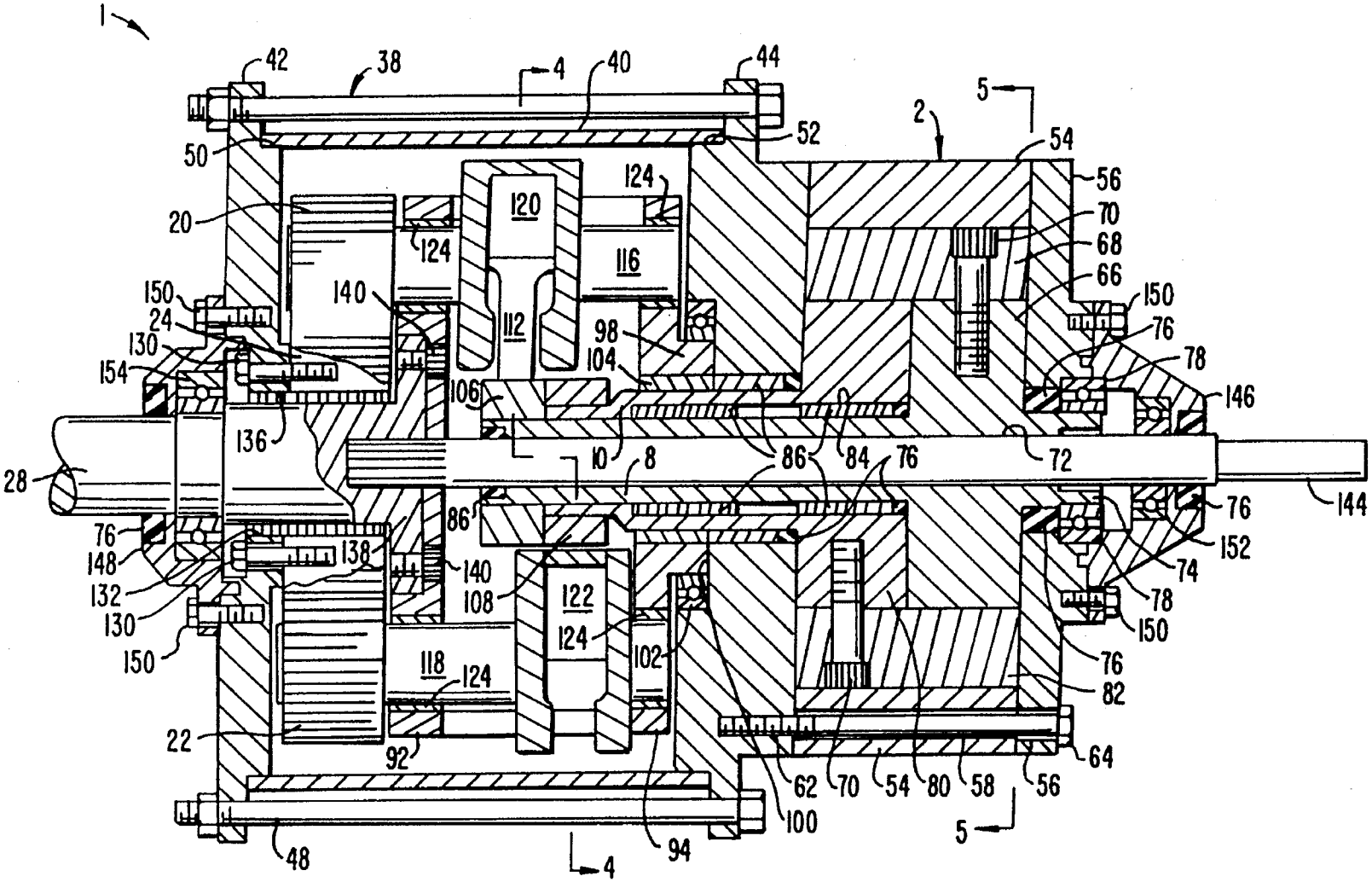
FIG. 3 is a sectional view of the engine of the FIG. 2.

Referring to FIGS. 2 and 3, the construction of rotary engine 1 will be described in detail. Rotary engine 1 includes transmission housing 38 coupled to piston assembly housing 2. Transmission housing 38 houses the planetary gear train and rotating crank assembly or crank cage 26. Housing 38 includes annular shell 40 and endplates 42, 44. Endplates 42 and 44 are provided with axially aligned holes 46 adjacent their periphery for receiving fasteners, such as bolts 48, to secure annular shell 40 between endplates 42, and 44. Endplates 42 and 44 further include annular shelves 50 and 52 which extend axially to support annular shell 40.

Piston assembly housing 2 includes annular shell 54 and endplate 56. Endplate 56 includes a plurality of holes 58 that extend in a circumferencial direction adjacent to its perimetrical side surface. Holes 58 are aligned with holes 60, which extend axially through annular shell 54, and threaded holes 62, which are formed in endplate 44. Fasteners, such as threaded bolts 64, are then passed through holes 58, 60 and 62 to secure piston assembly housing 2 to transmission housing 38. In this way, endplate 44, annular shell 54 and endplate 56 form a container for piston assemblies 4 and 6.

Figure 6:
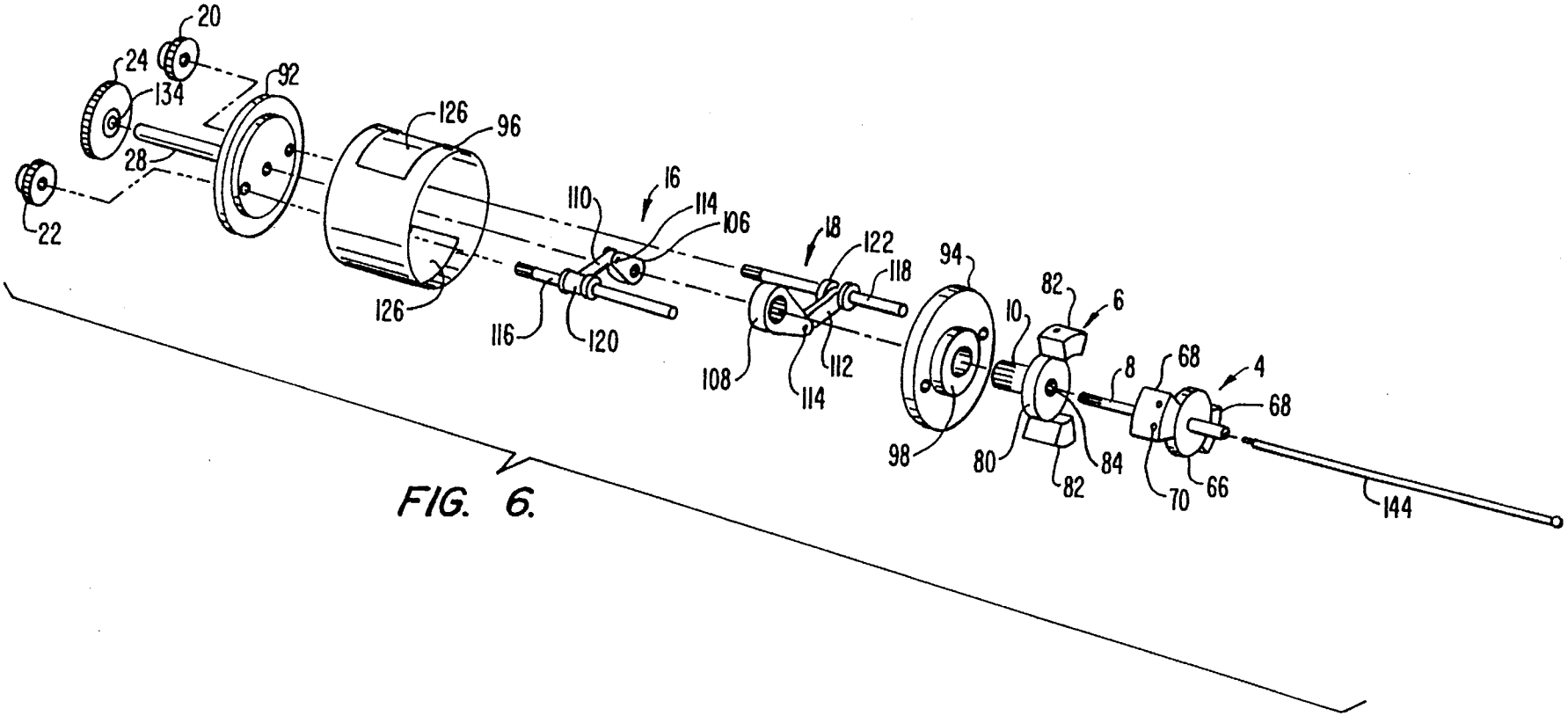
FIG. 6 is an exploded view of the power train illustrated in FIG. 2.

Referring to FIGS. 2, 3 and 6, piston assembly 4 includes hub or disc member 66 and diametrically opposed piston heads 68 which extend radially outwardly from hub or disc member 66. Piston heads 68 can be integrally formed with disc 66 or can be fastened to disc 66 with fasteners 70. Hollow cylindrical drive shaft 8 extends from hub 66 and is axially aligned with central bore 72 in hub 66. Tubular member 74 extends from the other side of hub 66 and also is axially aligned with central bore 72. Tubular member 74 extends through a central bore in endplate 56 and is rotatably supported therein by radial bearing 78. Annular seal 76 also is provided between endplate 56 and tubular member 74 to prevent pressure leakage.

Piston assembly 6 also includes a hub or disc member 80 and diametrically opposed piston heads 82 which extend radially outwardly from hub 80. As in piston assembly 4, piston heads 82 can be integrally formed with hub or disc member 80 or they can be fastened to hub 80 with fasteners 70. Cylindrical hollow drive shaft 10 extends from one side of hub 80 and is axially aligned with central bore 84 in hub 80. Referring to FIG. 3, drive shaft 8 extends through bore 84 and is concentrically positioned in drive shaft 10. As is evident from the drawings, the inner diameter of drive shaft 10 and central bore 84 is greater than the outer diameter of drive shaft 8 to permit shaft 8 to rotate in shaft 10. Bronze bearings 86, having lubricant channels as is known in the art, are disposed between drive shafts 8 and 10 and between draft shaft 10 and transmission housing 38 to further facilitate relative rotation therebetween.

Figure 5:
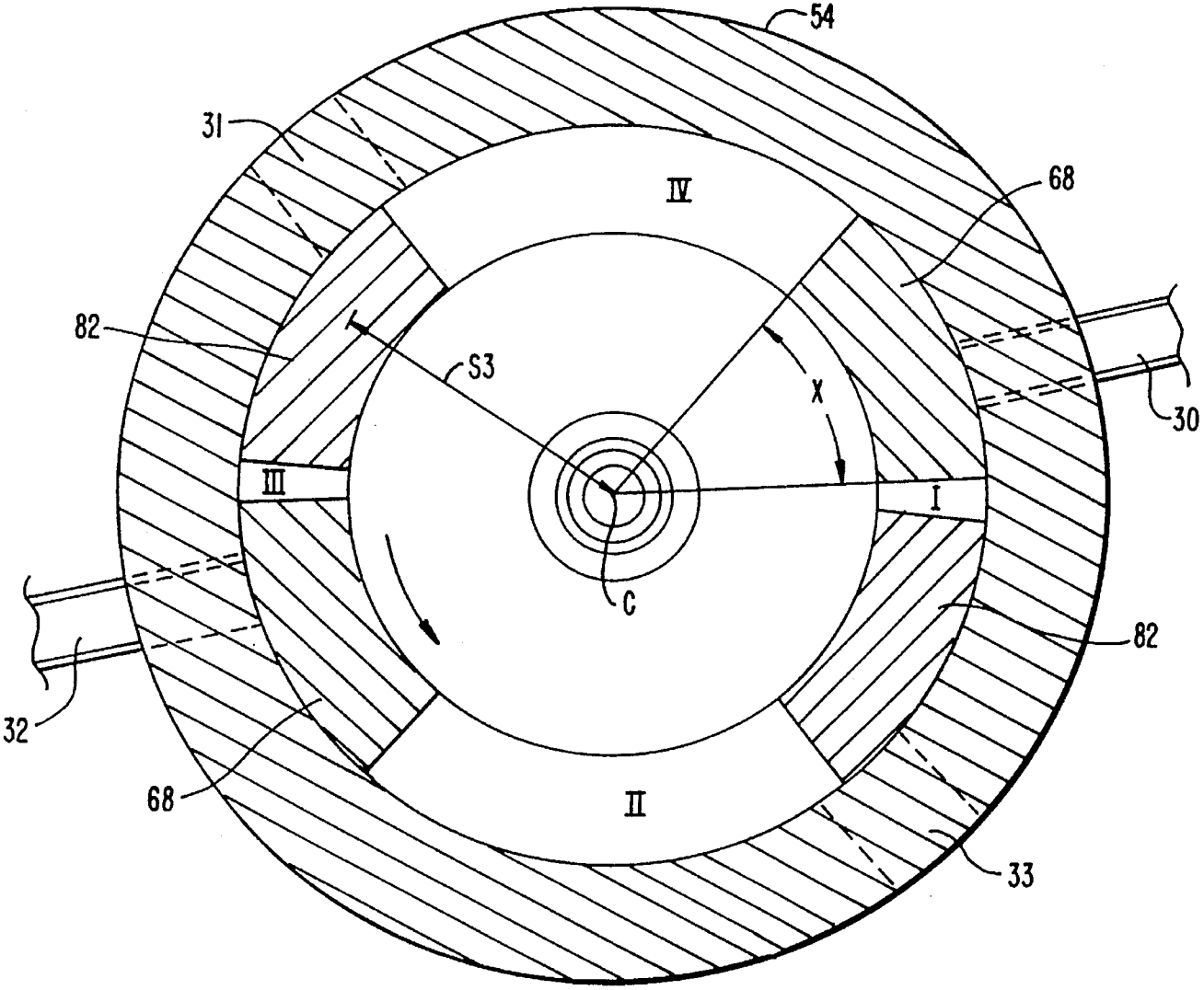
FIG. 5 is a sectional view taken along lines 5—5 in FIG. 3 illustrating the piston assembly.

Expansion chambers I, II, III, and IV are formed between piston heads 68 and 82 (FIGS. 2 and 5). Specifically, piston heads 68 include working surfaces 88, and piston heads 82 include working surfaces 90. These working surfaces form in part the expansion chambers and extend radially from hubs 66 and 80. Surfaces 82 and 90 also extend axially the combined width of the hub members such that each piston head extends from one hub and overlaps the other hub.

Crank assemblies 16 and 18, to which drive shafts 8 and 10 are coupled, are disposed in crank assembly housing or crank cage 26. Crank cage 26 includes two spaced apart disk-shaped walls 92, 94 and a cylindrical shell 96 disposed therebetween and secured thereto. Disk-shaped wall 94 includes annular flange 98 that extends toward the piston assemblies and into annular recess 100 formed in endplate 44. Annular flange 98 is rotatably mounted in annular recess 100 through radial bearing 102. Annular flange 98 also is journalled on concentric drive shafts 8 and 10 with bronze bearings 104. In this way, disk-shaped wall 94 can rotate about the longitudinal axis of rotating drive shafts 8 and 10.

Figure 4:
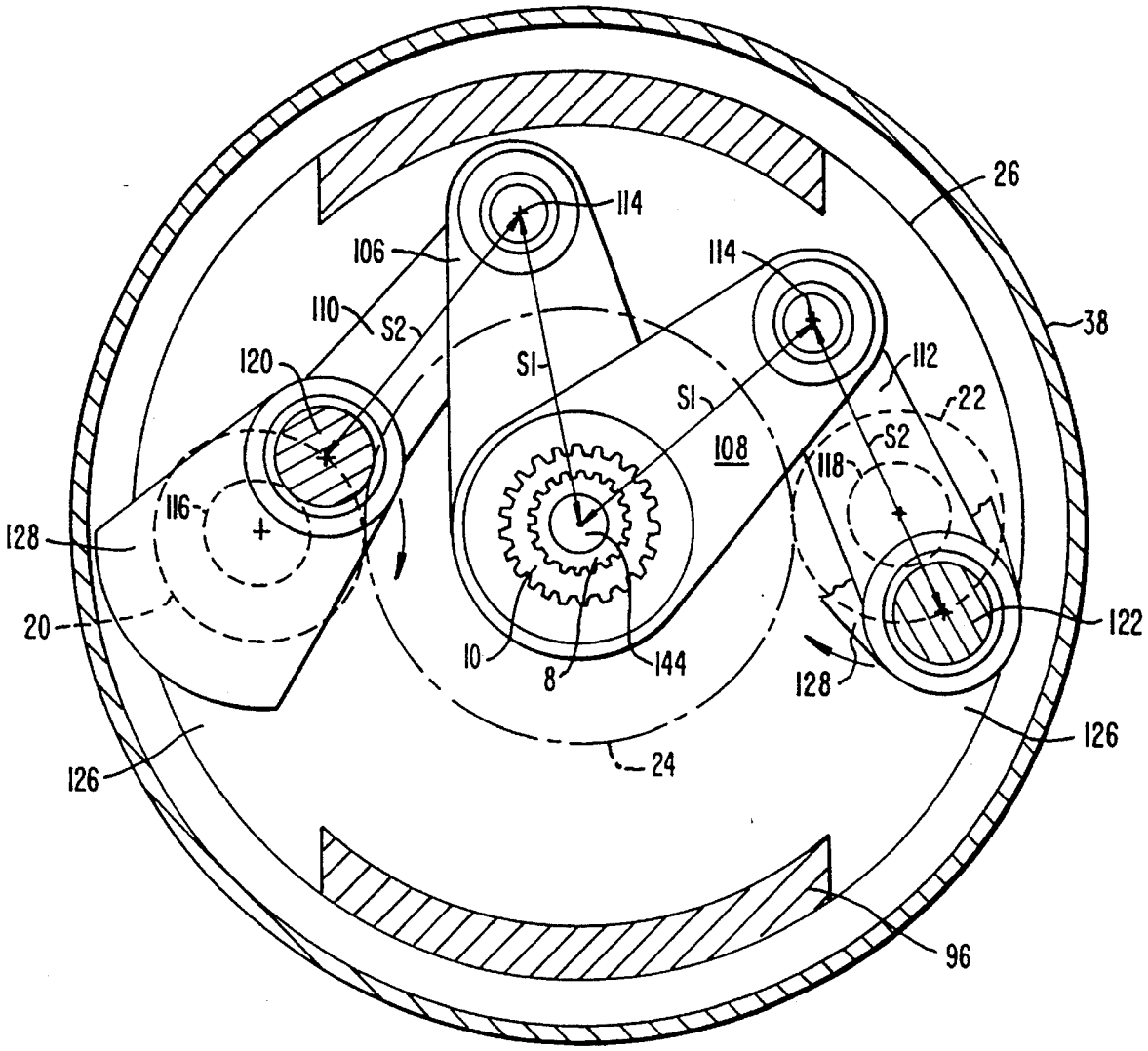
FIG. 4 is a sectional view taken along lines 4—4 in FIG. 3 illustrating the crank assembly.

The splined ends of shafts 8 and 10 (FIG. 2) extend into crank cage 26 and are coupled to crank assemblies 16 and 18 through the splined collar portions of crank levers or crank arms 106 and 108 into which they extend. Crank levers 106 and 108 are pivotally coupled to connecting rods 110 and 112 through pivot pins 114 (FIG. 6). Connecting rods 110 and 112 are coupled to crankshafts 116 and 118 through journal shafts 120 and 122 as is conventional to those skilled in the art to provide crankshafts 116 and 118 with rotation. Accordingly, crankshafts 116 and 118 are journalled in disk-shaped walls 92 and 94 with bronze bearings 124 and are fixedly coupled to planet gears 20 and 22 to provide the planet gears with rotational motion. Cylindrical shell 96 of crank assembly housing 26 includes diametrically opposed openings or slots 126 so that connecting rods 110 and 112 can pass therethrough during operation of the crank assemblies (FIGS. 3, 4 and 6). Crankshafts 116 and 118 also are provided with counterbalances 128 that are arranged to balance the crankshafts as is conventional in the art.

Sun gear 24 is fixedly secured to endplate 42 of transmission housing 38 such as by fasteners 130 to prevent rotation of the sun gear. Power output shaft 28 extends through central bores 132 and 134 formed in endplate 42 and sun gear 24 and is rotatably mounted therein with bronze bearings 136. Output shaft 28 includes an annular flange 138 that is fixedly secured to disk-shaped wall 92 of crank cage 26 with fasteners 140, for example. This arrangement ensures that output shaft 28 rotates with crank cage 26 about the longitudinal axes of shafts 8 and 10. The blind end of output shaft 28 also includes a splined bore into which the splined end of auxiliary shaft 144 is secured for rotation with output shaft 28. Auxiliary shaft 144 then extends through drive shafts 8 and 10 and beyond endplate 56 to provide auxiliary power to accessories. The longitudinal axes of drive shafts 8 and 10, auxiliary shaft 144 and output shaft 28 are coincident.

End caps 146 and 148 are secured to endplates 56 and 42 with, for example, fasteners 150, to seal the piston assembly housing 2 and transmission housing 38 from the environment. End caps 146 and 148 are provided with seals 76 to seal the shaft openings and radial bearings 152 and 154, which are spaced axially inwardly from the seals, to further rotatably support auxiliary shaft 144 and output shaft 28.

Referring to FIG. 5, the synchronization of piston heads 68 and 82 with inlet and outlet ports 30–33 will be described. As described above, piston assemblies 4 and 6 rotate about a common axis illustrated in FIG. 5 with reference character C. As piston heads 68 and 82 rotate in the counterclockwise direction prior to a power stroke, expansion chambers I and III align with diametrically opposed pressure inlet ports 30 and 32. The high pressure fluid, preferably high pressure vapor, flows into chambers I and III and generates a counterclockwise force against the trailing working surfaces of piston heads 68 which accelerates piston heads 68 in the counterclockwise direction, while generating a clockwise force against the leading working face of piston heads 82 which places pistons 82 in a power cranking mode. The pressure thus applied of course tends to move piston heads 68 forwardly in the counterclockwise direction and piston heads 82 in the opposite direction. However, reverse motion of piston heads 82 is generally offset by the advancement of the planetary gears driven by forwardly advancing piston heads 68 as discussed above with reference to FIG. 1. Thus, piston heads 82 essentially do not move in a reverse direction during the power stroke. They remain essentially stationary relative to annular shell 54 of piston assembly housing 2 during the power stroke. Since diametrically opposed exhaust ports 31, 33 are angularly spaced 120° from inlet ports 30, 32 in the counterclockwise direction (60° in the clockwise direction), piston heads 68 rotate 120° in the power stroke. Due to the position of exhaust ports 31 and 33, exhaust occurs throughout the entire 120° power stroke. After the power stroke has been completed, pistons 68 and 82 roll together in a counterclockwise direction 30°. This motion positions pistons 68 and 82 for their next power stroke.

An expansion chamber goes through its full expansion and exhaust cycles during a quarter revolution of the crank assembly housing 26. While chamber I goes through a complete cycle, that is, an expansion and exhaust stroke, each of the remaining chambers II, III and IV experiences the same 90° cycle (phase shift). It is thus apparent that during each crank revolution of crank cage 26 or turn of output shaft 28, drive shafts 8 and 10 together with output shaft 28 are subjected to four equally spaced double power pulses which is two times the rate of power impulses obtained from a conventional 8-cylinder linear reciprocating combustion engine. For every 90° of planetary gear and crank motion, there is 30° of lever motion. Through the motions, there is a translation of 120° of piston motion times four which equals 480° which equates to 120° overlap in piston motions. The 30° lever motion and gear 90° travel motion also occurs in the lagging piston head as a driven power reversal which makes the lagging piston seem to be motionless, but which is in an equal velocity and travel to the stroking piston. Accordingly, the present invention accomplishes a 240° working power stroke per impulse.

To achieve the above results and provide inherent automatic synchronization between the four piston heads and inlet and outlet ports 30–33 without the need for complicated valve control systems, the following geometry is incorporated.

The gear ratio between the sun gear and the planet gears is two to one so that the crank assembly housing 26 rotates at one-half the rate at which planet gears 20 and 22 rotate, and therefore also at one-half the rate in which piston assemblies 2 and 4 rotate. In addition, the distance between the outer periphery of each piston head and the hub from which it extends is less than or equal to about one-third the distance between the outer periphery of each piston head and said axis. Further, the piston heads extend over an arc of essentially not more than 37.5° (leaving 210° to expansion chamber space) and the engine is configured to essentially equal moment arms. Equal moment arms are provided by constructing the elements such that the following distances are equal: the distances between the rotational axis of crank levers 106 and 108 to the center of pivot pins 114 (designated with reference character S1 in FIG. 4); the distance between pivot pins 114 and the center of crank shaft journals 120 and 122 (designated with reference character S2 in FIG. 4); and the distance between the rotational axis of the piston assemblies to the radial center of the working surface of each piston head (designated with reference character S3 in FIG. 5). With the moment arms being essentially equal, the planetary gear ratio being 2 to 1 and the piston head arc or included angle formed by the pair radially extending working surfaces of each piston head and axis C being not more than or equal to about 37½, the motions of the pistons are synchronized such that they line up with the inlet and outlet ports. In this way, the piston assemblies rotate in the same direction with changing rates of rotation to open and close the expansion chambers disposed between the piston heads in a coordinated cycle whereby the expansion chambers uncover an inlet port when they are approximately at their smallest volume and uncover an exhaust port when they are at their largest volume. Further, the above parameters ensure that contact between piston heads is avoided.

The timing of rotary engine 1 is adjusted by simply indexing the planet gears on the sun gear one or two teeth at a time until all motions of the pistons are equal. The pistons motions are equal when, for example, the dimensions of chambers I and III are equal.

The construction of the rotary engine in accordance with the principles of the present invention results in several heretofore unobtainable advantages. First, vibrations from non-rotary motions of parts, e.g., linear motion of reciprocating pistons and valves, are eliminated. Second, most internal parts of the engine rotate to provide a large inertia. Third, the engine generates torque which is not solely dependent on the engine revolutions per minute (rpm) since forces imposed on a given piston side during the expansion cycle of the engine are translated directly into torque as a function of the cylinder inlet pressure.

In typical reciprocating engines, the force applied by a piston to its crankshaft and the resulting torque is a function of both the cylinder pressure and the relative angular position of the crank. In the rotary engine of the present invention, the resulting torque induced into shafts 8 and 10 is the force acting on a given piston side times the radial distance between the axes of the shafts 8 and 10 and the center of the force on the piston. The torque generated by crankshafts 116, 118, assuming a 1:1 ratio between the moment arm of connecting rods 110, 112 and the crankshafts, is equal to the torque generated by the pistons on shafts 8 and 10. The 2:1 planetary gear train ratio doubles the output torque available from output shaft 28.

The generated torque in the present invention is proportionately very large, as compared to reciprocating engines, by virtue of the long moment arm which in a typical size engine of the present invention is about six inches. The maximum torque is generated upon expansion of the air in the chambers between the pistons which is immediately (i.e., directly) transmitted to shafts 8 and 10. In contrast thereto, a conventional internal combustion reciprocating engine has a torque generating moment arm on its crankshaft of usually no more than about 3 inches. When the combusting fuel exerts maximum pressure on the piston in such reciprocating engines, the available moment arm is very small due to the near alignment of the crank journal, the connecting rod, and the piston during the initial instant of the combustion process until it reaches a maximum at 90 degrees past top dead center. Thus, it is clear that the proposed engine greatly increases the available torque from a specific engine size purely due to its geometry. Perhaps even more importantly, that torque is available not only at high rpm but almost to the same degree at relatively low rpm as the example demonstrates. Significant simplification in the power drive train for motor driven vehicles is thus possible.

Obviously, the sizes and materials used to make up the rotary engine may be selected from a wide variety of sizes and/or materials. Merely to exemplify a preferred makeup of the materials used, the following example may be recited. The piston heads, piston hubs, crank levers, connecting rods and crank cage endplates comprise high grade aluminum, e.g., 6061T6 A1. The remaining components including oscillating shafts 8, 10, crank cage shell 96 and crankshafts 116, 118 comprise mild steel.

The above is a detailed description of a particular embodiment of the invention. It is recognized that departures from the disclosed embodiment may be made within the scope of the invention and that obvious modifications will occur to a person skilled in the art. The full scope of the invention is set out in the claims that follow and their equivalents. Accordingly, the claims and the specification should not be construed to unduly narrow the full scope of protection to which the invention is entitled.

What is claimed is:

1. A piston assembly for a pressurized fluid rotary engine, comprising:

a housing;

piston heads rotatably mounted in said housing about a common axis for travel in a circular path, each piston head having a pair of working faces, each working face facing a working face on an adjacent piston head, a portion of each working face of a respective piston head defining an included angle with respect to said axis of about 37.5 degrees; and a pair of tubular shafts rotatably mounted about said axis and coupled to said pistons for transferring energy between said pistons and a transmission.

2. The piston assembly of claim 1 wherein said included angle is 37.5 degrees.

3. The piston assembly of claim 1 wherein said housing includes two pressure inlet ports adapted to provide pressurized fluid between adjacent piston heads and two exhaust ports adapted to exhaust expanded fluid from between adjacent piston heads.

4. A piston assembly for a pressurized fluid rotary engine, comprising:

a housing;

a first hub rotatably mounted in said housing about said axis;

a second hub rotatably mounted in said housing about said axis;

a pair of tubular drive shafts each coupled to one of said first and second hubs, said tubular drive shafts being rotatably mounted about said axis;

a first set of piston heads that extend radially outward from said first hub;

a second set of piston heads that extend radially outwardly from said hub, each piston head from said second set being circumferentially spaced from a piston head of said first set to form a fuel expansion chamber therebetween;

wherein the distance between the outer periphery of each piston head and the hub from which it extends is less than or equal to about one-third the distance between the outer periphery of each piston head and said axis; and wherein said piston heads are wedge-shaped, each wedge-shaped head defining an arc having a center on said axis, said arc being about 37.5 degrees in the circumferential direction of said hubs.

5. The piston assembly of claim 4 wherein the distance between the outer periphery of each piston head and the hub from which it extends is at maximum one-third the distance between the outer periphery of each piston head and said axis.

6. The piston assembly of claim 4 wherein said arc is 37.5 degrees.

7. The piston assembly of claim 4 wherein each piston head extends about 37.5 degrees relative to the circumference of each hub.

8. The piston assembly of claim 4 wherein each piston head includes a leading and trailing surface, each leading surface facing a trailing surface, a portion of the leading and trailing surfaces of each piston head define an included angle with respect to said axis of less than or equal to about 37.5 degrees.

9. The piston assembly of claim 4 wherein said piston heads extending from said first hub further extend over the perimetrical side surface of said second hub, and said piston heads extending from said second hub extend over the perimetrical side surface of said first hub.

10. The piston assembly of claim 4 wherein said housing includes pressure inlet ports adapted to provide pressurized fluid into said expansion chambers and exhaust outlet ports adapted to exhaust expanded fluid from said expansion chambers, the number of inlet ports being equal to the number of outlet ports.

11. The piston assembly of claim 10 wherein said housing includes two inlet ports and two outlet ports.

12. The piston assembly of claim 11 wherein at least one inlet port is spaced 120 degrees from one outlet port and 60 degrees from the other outlet port.

13. The piston assembly of claim 12 wherein said housing has an annular surface that faces said piston heads, said inlet ports being diametrically opposed in said annular surface.

14. A pressurized fluid rotary engine, comprising:

a piston housing;

first and second hubs, each hub being rotatably supported in said piston housing about a common axis;

piston heads extending radially outwardly from said hubs for travel in a circular path about said axis, each piston head having a pair of working surfaces, each working surface facing the piston head adjacent thereto;

a transmission housing coupled to said piston housing;

an output shaft extending from said transmission housing;

a pair of crank levers each coupled to one of said hubs and rotatably mounted about said axis;

a pair of connecting rods each having first and second portions, each first end portion being pivotally coupled to one of said crank levers;

a sun gear connected to said transmission housing;

a pair of planet gears coupled to said sun gear;

a pair of crank journals; and a pair of crankshafts each having a first portion pivotally coupled through one of said crank journals to said second end portion of one of said connecting rods and a second portion coupled to one of said planet gears and said output shaft for rotating said planet gears and said output shaft;

wherein the distance between the outer periphery of each piston head and the hub from which it extends is less than or equal to about one-third the distance between the outer periphery of each piston head and said axis; and wherein the leading and trailing surfaces of each piston head defining an included angle of about 37.5 degrees with respect to said axis.

15. The rotary engine of claim 14 wherein the gear ratio between the sun and planet gears is 2 to 1.

* * * * *